US012442175B1

(12) United States Patent
Larson et al.

(10) Patent No.: US 12,442,175 B1
(45) Date of Patent: Oct. 14, 2025

(54) PREFABRICATED BUILDING SYSTEMS AND ELEMENTS THEREOF

(71) Applicants: XL Construction Corporation, Milpitas, CA (US); Aedis, Inc., San Jose, CA (US); Daedalus Engineering, Inc., Saratoga, CA (US)

(72) Inventors: Matthew Larson, Saratoga, CA (US); Douglas R. Robertson, Saratoga, CA (US); Afsha Ali, Milpitas, CA (US)

(73) Assignees: XL Construction Corporation, Milpitas, CA (US); Aedis, Inc., San Jose, CA (US); Daedalus Engineering, Inc., Saratoga, CA (US)

( * ) Notice: Subject to any disclaimer, the term of this patent is extended or adjusted under 35 U.S.C. 154(b) by 445 days.

(21) Appl. No.: 17/829,040

(22) Filed: May 31, 2022

(51) Int. Cl.

| | |
|---|---|
| ***E04B 1/10*** | (2006.01) |
| ***E04B 1/08*** | (2006.01) |
| ***E04B 5/00*** | (2006.01) |
| *E04B 1/24* | (2006.01) |

(52) U.S. Cl.
CPC ..... *E04B 1/10* (2013.01); *E04B 1/08* (2013.01); *E04C 1/24* (2013.01); *E04B 2001/2481* (2013.01); *E04B 2001/2484* (2013.01)

(58) Field of Classification Search
CPC ..... E04B 1/10
See application file for complete search history.

(56) References Cited

U.S. PATENT DOCUMENTS

| | | | | |
|---|---|---|---|---|
| 2,308,790 | A * | 1/1943 | Stagg | E04B 2/14 52/550 |
| 9,297,158 | B2 | 3/2016 | Lundmark et al. | |
| 10,202,752 | B2 * | 2/2019 | Dunster | E04B 5/10 |
| 11,578,483 | B2 * | 2/2023 | Schoenhard | E04B 2/58 |
| 2009/0113820 | A1 * | 5/2009 | Deans | E04B 1/14 52/800.1 |
| 2017/0284079 | A1 * | 10/2017 | Scaccia | E04H 1/12 |
| 2018/0023283 | A1 * | 1/2018 | Dunster | E04B 1/24 52/220.1 |
| 2022/0349175 | A1 * | 11/2022 | Schoenhard | E04B 1/7608 |

* cited by examiner

*Primary Examiner* — Joshua K Ihezie
(74) *Attorney, Agent, or Firm* — Spano Law Group; Joseph S. Spano

(57) ABSTRACT

A sustainable, prefabricated building system, including prefabricated wall panels, load bearing beams, and prefabricated roof panels, and methods of assembly are presented herein. In one aspect, a prefabricated building assembly includes a number of prefabricated wall panel subassemblies mounted to a concrete foundation with a desired offset distance between the bottom of each prefabricated wall panel assembly and the foundation. Each prefabricated wall panel includes a metal base angle subframe coupled to structural wood subassembly. In another aspect, a metal base angle subframe includes end caps welded to each end of the structural angle to facilitate weather proofing and isolation of the wall panel assembly from the ground. In some embodiments, a wall panel subassembly includes any of an interior facing finishing layer, one or more utility chases, a weather resistive membrane, an insulation layer, one or more flashing elements, and an exterior finishing layer.

27 Claims, 9 Drawing Sheets

PREFABRICATED BUILDING SYSTEMS AND ELEMENTS THEREOF

TECHNICAL FIELD

The described embodiments relate to structural members and subassemblies for prefabricated building systems, and more particularly to prefabricated wall and roof subassemblies, and structural elements thereof.

BACKGROUND INFORMATION

Various prefabricated wall and roof subassemblies are commonly utilized to lower the cost and increase the speed of building construction. Predesigned, prefabricated wall and roof subassemblies are typically selected from an existing catalog of available subassemblies based on specific project dimensions and loads. Fabrication shops cost efficiently and repetitively fabricate predesigned subassemblies with dedicated tooling and processes. The prefabricated wall and roof subassemblies are manufactured off-site and transported to the construction site in multiple sections. Multiple sections are assembled on-site to realize a full length wall or roof.

Typical prefabricated wall and roof subassemblies include the structural timber framing elements only. The prefabricated wall and roof frame segments are hoisted into place, and quickly nailed or bolted together. This approach eliminates having to cut and assemble each timber piece on-site, and allows relatively easy access to assemble the wall and roof subassemblies. In some embodiments, prefabricated wall and roof subassemblies include both the structural timber framing elements and exterior sheathing elements. In this manner, the prefabricated wall and roof subassemblies are hoisted into place, and joined together, e.g., using nails, bolts, metal straps, etc. In general, as wall and roof subassemblies become more highly integrated, i.e., including more elements of the finished building, the assembly of the subassemblies typically becomes more complex. In some examples, physical access is limited and effectively joining subassemblies together and sealing the joined subassemblies from the external environment, e.g., rain, wind, ice, etc., becomes more difficult.

A building assembly fabricated from commonly available prefabricated wall and roof subassemblies lowers the cost and increases the speed of conventional building tasks on site. Unfortunately, many tasks remain. For example, the insulating, sealing, external finishing, interior finishing, and mechanical, electrical, and plumbing installations remain unchanged compared to conventional, on-site construction. Thus, the cost reduction and time savings accrued from the use of typical prefabricated wall and roof subassemblies is often overshadowed by the total cost and time associated with construction of the complete building.

In summary, current prefabricated wall and roof subassemblies provide limited advantages from both a cost and time perspective. Improvements to prefabricated wall and roof subassemblies are desired to provide further reductions in cost, time, and environmental impact.

SUMMARY

A sustainable, prefabricated building system and methods of assembly thereof are presented herein. Prefabricated wall panels, load bearing beams, and prefabricated roof panels are pre-fabricated elements of the sustainable, prefabricated building system. The prefabricated building elements facilitate efficient building erection on-site without expensive and time consuming framing and finishing tasks.

In one aspect, a prefabricated building assembly includes a number of prefabricated wall panel subassemblies. Each prefabricated wall panel includes a metal base angle subframe coupled to a structural wood subassembly. Each prefabricated wall panel is assembled off-site and delivered to the job-site ready for erection as part of a prefabricated building system.

In another aspect, a metal base angle subframe includes end caps welded to each end of the structural angle to facilitate weather proofing and isolation of the wall panel assembly from the ground.

In another aspect, one or more utility chases are fabricated into a mass timber panel of a wall panel subassembly during fabrication. A utility chase is a cavity or channel fabricated into the mass timber panel to accommodate mechanical elements of the building, e.g., electrical, plumbing, communications infrastructure, etc.

In another further aspect, a wall panel subassembly includes a weather resistive membrane attached to a structural wood subassembly. The weather resistive membrane provides a material layer to block environmental elements, e.g., insects, water, etc., that might damage the mass timber panel.

In another further aspect, a wall panel subassembly includes an insulation layer attached to the exterior face of the structural wood subassembly, e.g., a sheathing layer.

In another further aspect, a wall panel subassembly includes one or more metal flashing elements attached to the exterior face of the structural wood subassembly, e.g., a sheathing layer, to direct any water that penetrates the exterior finishing layer away from the structural wood subassembly.

In another further aspect, a wall panel subassembly includes an exterior finishing layer attached to the exterior facing side of the wall panel subassembly. In general, any suitable external finish may be applied, e.g., stucco, weatherproof panels, siding, etc.

In another further aspect, a number of prefabricated wall panel assemblies are erected as part of a prefabricated building system. In addition, each prefabricated wall panel assembly is mounted to a concrete foundation with a desired offset distance between the bottom of each prefabricated wall panel assembly and the foundation. By separating the prefabricated wall panel assembly from the foundation by a distance, exposure of the prefabricated wall panel assembly to destructive environmental elements, e.g., water, insects, termites, etc., is minimized.

In another aspect, a prefabricated building assembly includes a number of prefabricated wall panel assemblies integrated into a perimeter wall, a set of support beams attached across the perimeter walls, and a set of prefabricated roof panels disposed on the set of support beams.

The foregoing is a summary and thus contains, by necessity, simplifications, generalizations and omissions of detail; consequently, those skilled in the art will appreciate that the summary is illustrative only and is not limiting in any way. Other aspects, inventive features, and advantages of the devices and/or processes described herein will become apparent in the non-limiting detailed description set forth herein.

DETAILED DESCRIPTION

Reference will now be made in detail to background examples and some embodiments of the invention, examples of which are illustrated in the accompanying drawings.

A sustainable, prefabricated building system and methods of assembly thereof are presented herein. As a timber-based building system, the timber structural elements are renewable and retain the carbon sequestered during tree growth prior to harvest.

In some embodiments, prefabricated wall panels, load bearing beams, and prefabricated roof panels are pre-fabricated elements of the sustainable, prefabricated building system. The prefabricated building system is designed and detailed using available software based design tools, such as Computer Aided Design (CAD) software tools, Building Information Modeling (BIM) software tools, other structural analysis software, etc. The resulting Building Information Model (BIM) may be directly communicated to Computer Numerically Controlled (CNC) cutting and gluing equipment for precision automated fabrication. The prefabricated building elements facilitate efficient building erection on-site without expensive and time consuming framing and finishing tasks.

In one aspect, a prefabricated building assembly includes a number of prefabricated wall panel subassemblies. Each prefabricated wall panel includes a metal base angle subframe and a structural wood subassembly. Each prefabricated wall panel is assembled off-site and delivered to the job-site ready for erection as part of a prefabricated building system.

Figure 1:
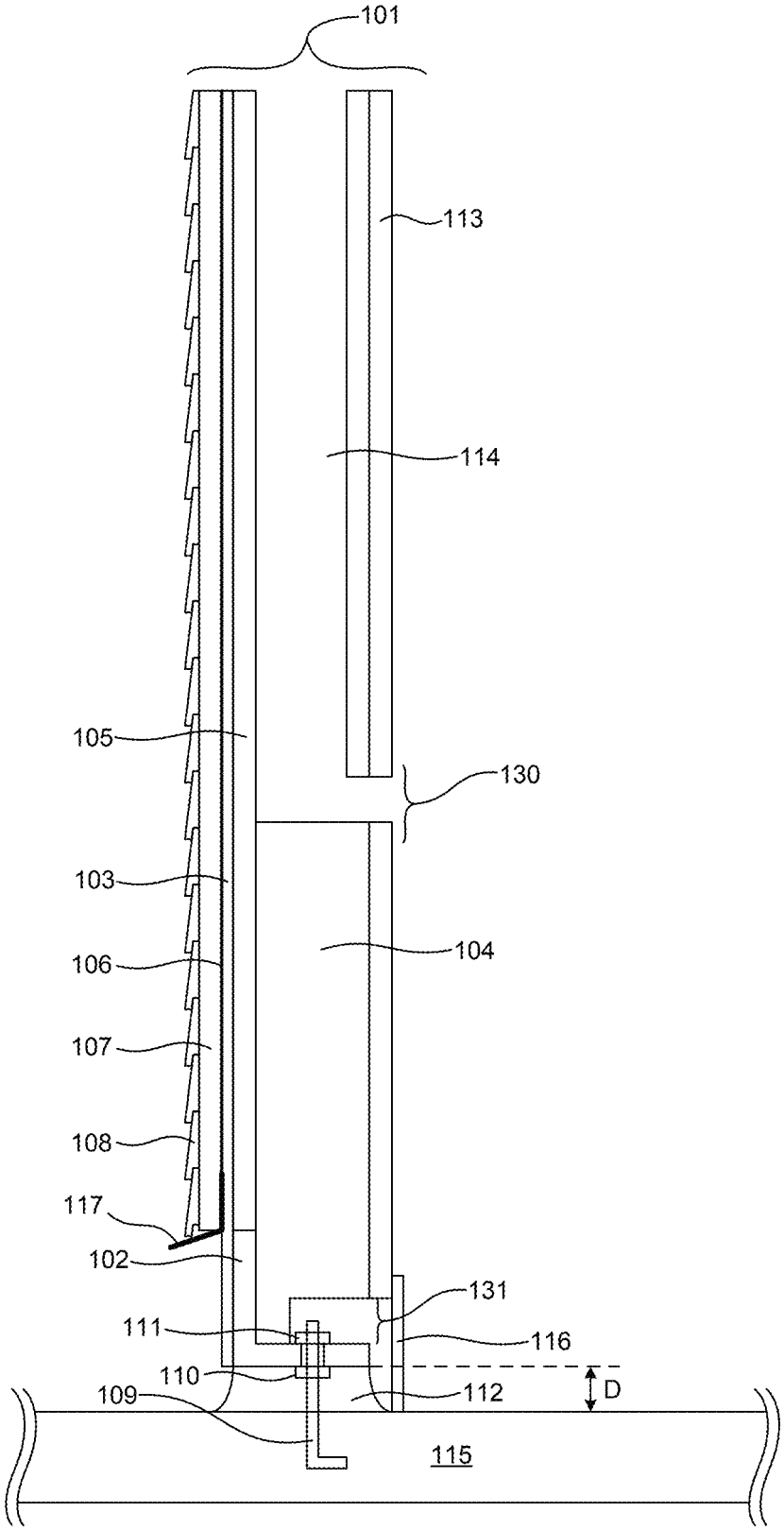
FIG. 1 is a diagram illustrative of a cross sectional view of a prefabricated wall panel assembly in one embodiment.

FIG. 1 depicts a cross-sectional view of a wall panel subassembly in one embodiment. An exterior face of wall panel subassembly 101 is oriented toward the left of the drawing page, and an interior face of wall panel subassembly 101 is oriented toward the right of the drawing page. A bottom face of wall panel subassembly 101 is oriented toward the bottom of the drawing page, and a top face of wall panel subassembly 101 is oriented toward the top of the drawing page. Wall panel subassembly 101 includes a metal base angle subframe fastened to a mass timber panel.

Figure 2:
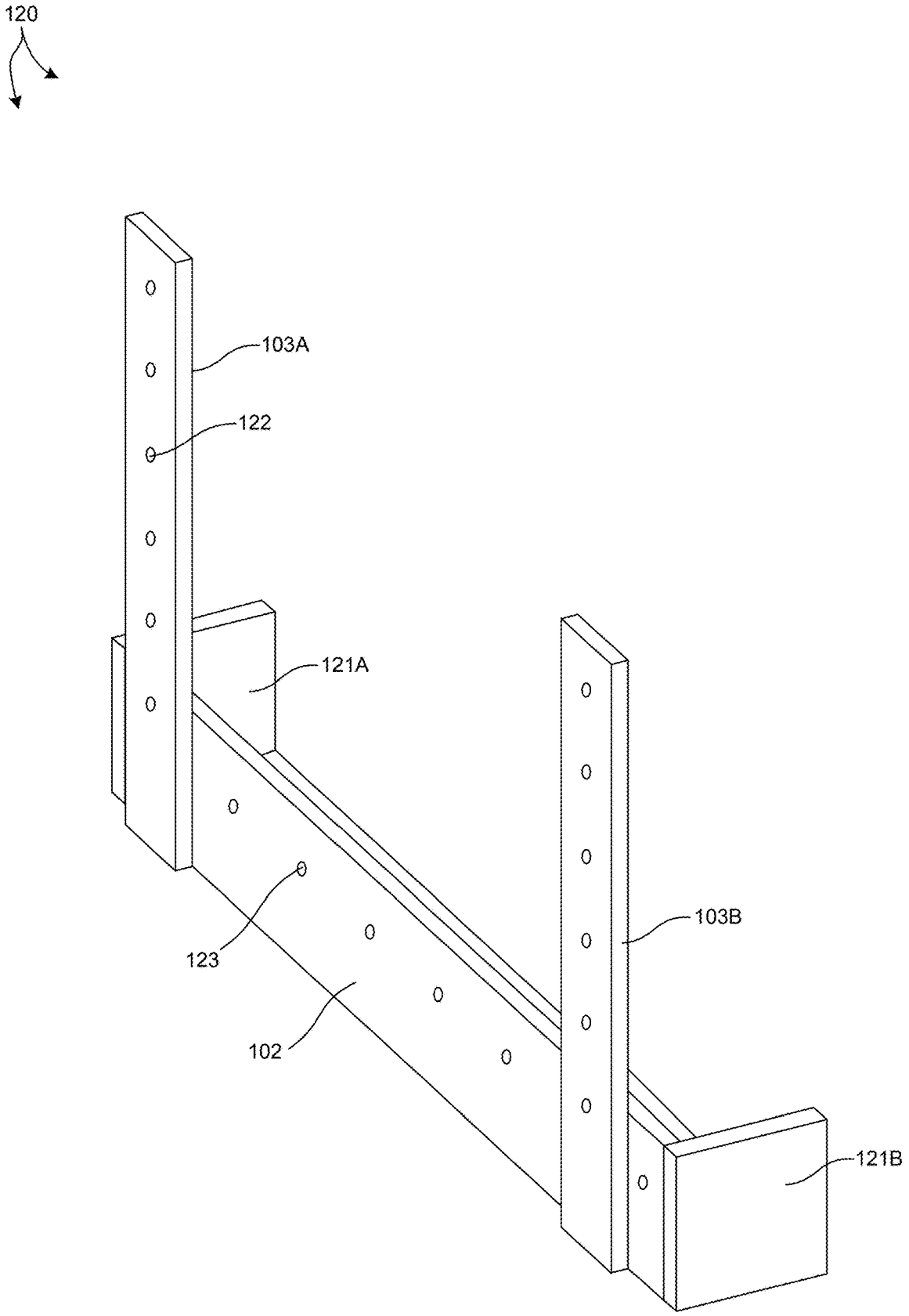
FIG. 2 is a diagram illustrative of a metal base angle subframe in one embodiment.

FIG. 2 depicts a perspective view of a metal base angle subframe 120 in one embodiment. In the embodiment depicted in FIG. 2, metal base angle subframe 120 includes structural angle 102, metal straps 103A-B, and endcaps 121A-B welded together as a unitary subframe. As depicted in FIG. 2, structural angle 102 has an L-shaped cross-sectional profile including two flanges perpendicular to one another. When oriented in an upright position, for example as part of an installed wall panel, one flange extends vertically, perpendicular to the ground, and the other flange extends horizontally, parallel to the ground. The direction of extent of the structural angle itself is perpendicular to the direction of extent of both flanges, parallel to the ground. Structural angle 102 provides resistance to bending, shear, and tension in any direction. The thickness of the flanges of structural angle 102 may be any suitable dimension. In some embodiments, a thickness of ½ inches is preferred. The length of the flanges in their respective directions of extent may be any suitable dimension. In some embodiments, the length of each flange is equal. In other embodiments, the length of each flange is unequal. In a preferred embodiment, the length of each flange is 4-6 inches.

In some embodiments, metal straps 103A and 103B are welded to the vertically oriented flange and the direction of extent of the metal straps is parallel to the direction of extent of the vertically oriented flange. Although FIG. 2 depicts two straps welded to structural angle 102, in general, any number of metal straps may be welded to structural angle 102 and spaced apart in any desired manner.

As depicted in FIG. 2, metal straps 103A-B include periodically spaced holes 122. Similarly, the vertically oriented flange of structural angle 102 also includes periodically spaced holes 123. The holes are available to accommodate fasteners, e.g., bolts, screws, nails, etc., to attach a mass timber panel to the metal base angle subframe 120.

Figure 10:
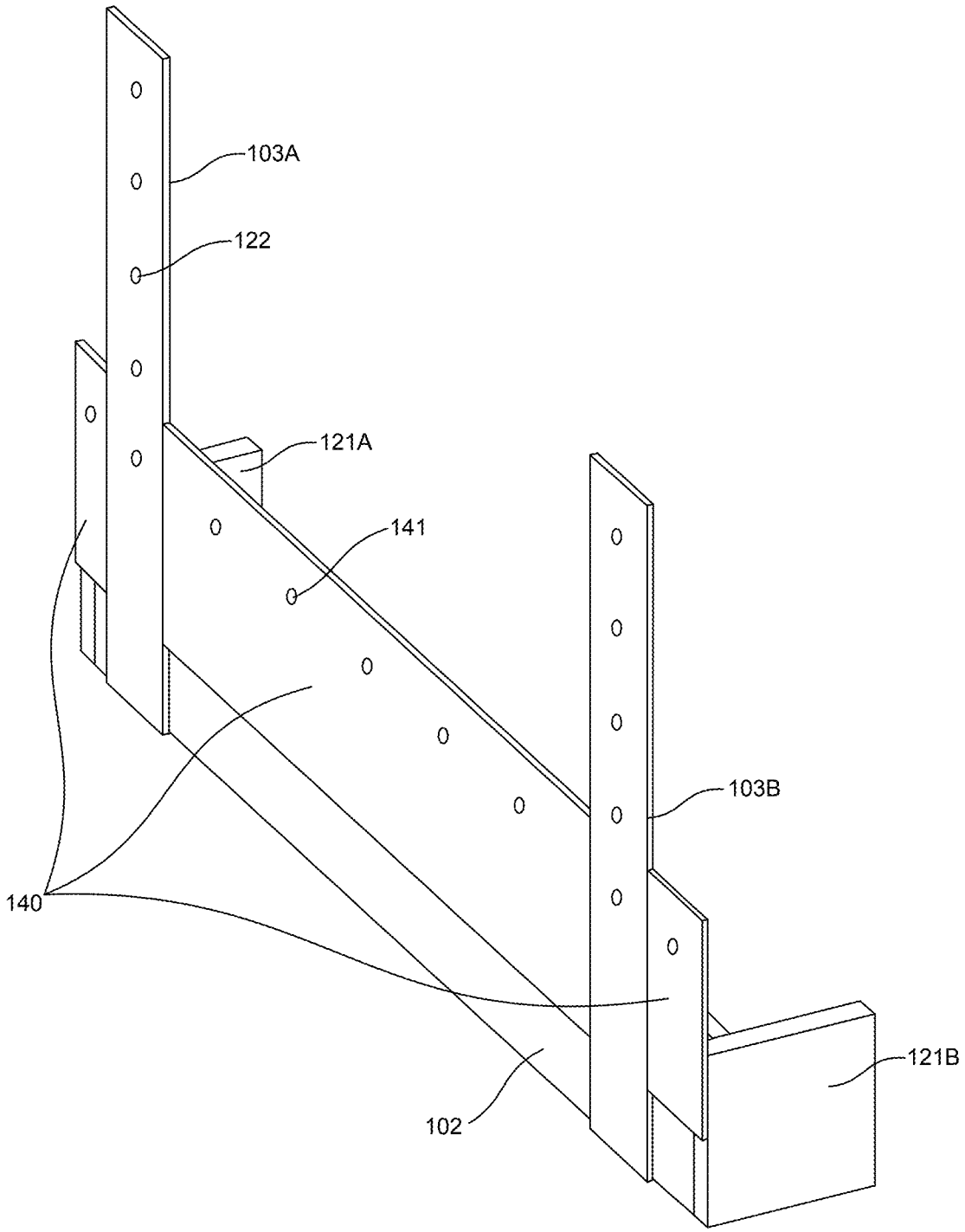
FIG. 10 is a diagram illustrative of a metal base angle subframe in another embodiment.

FIG. 10 depicts a perspective view of metal base angle subframe 120 in another embodiment. In the embodiment depicted in FIG. 10, metal base angle subframe 120 includes structural angle 102, vertically oriented metal straps 103A-B, horizontally oriented strap 140, and endcaps 121A-B welded together as a unitary subframe. As depicted in FIG. 10, are welded to the vertically oriented flange and the direction of extent of the metal straps is parallel to the direction of extent of the vertically oriented flange. In addition, a horizontally oriented strap 140 is welded to the vertically oriented flange of structural angle 102. The width of the bar extends in the vertical direction and the length of the bar extends along the length of structural angle 102. As depicted in FIG. 10, metal strap 140 includes periodically spaced holes 141. The holes are available to accommodate fasteners, e.g., bolts, screws, nails, etc., to attach a mass timber panel to the metal base angle subframe 120. In the embodiment depicted in FIG. 10, there are no holes drilled through structural angle 102. As a result, the mass timber panel is attached to the metal base angle subframe 120 using fasteners through holes 122 of horizontally oriented strap 140 and holes 123 of vertically oriented straps 103A-B.

In another aspect, a metal base angle subframe includes end caps welded to each end of the structural angle to facilitate weather proofing and isolation of the wall panel assembly from the ground. As depicted in FIGS. 2 and 10, metal base angle subframe 120 includes end caps 121A and 121B welded to the ends of structural angle 102. In the embodiments depicted in FIGS. 2 and 10, the end caps 121A-B extend in the vertical and horizontal direction to the full length of the flanges of structural angle 102. In this manner, the end caps 121A-B fully close off the ends of structural angle 102.

In some embodiments, metal straps 103A and 103B are welded to the end caps and the direction of extent of the metal straps is parallel to the direction of extent of the vertically oriented flange. In general, any number of metal straps may be welded to the end caps and spaced apart in any desired manner.

The elements of metal base angle subframe 120 may be fabricated from any suitable material, e.g., structural steel, stainless steel, aluminum, etc. Common grades of structural steel include A36, A572, A588, GR 50, CSA 44W, CSA 50W, etc. In addition, the elements of metal base angle subframe 120 may be treated by any suitable process to prevent corrosion, e.g., hot-dip galvanization, powder coating, painting, etc., by applying a layer of protective material to metal base angle subframe 120.

As depicted in FIG. 1, a structural wood subassembly includes a mass timber panel and sheathing layer 105 fastened to a metal base angle subframe including structural angle 102 and metal strap 103. The exterior facing sheathing layer 105 is disposed between the mass timber panel 104 and metal straps 103. The bottom surface of the structural wood subassembly rests on the horizontal flange of structural angle 102, and the exterior facing side of the structural wood subassembly abuts the vertical flange of structural angle 102 and metal strap 103.

As depicted in FIG. 1, the structural wood subassembly extends vertically, parallel to metal strap 103, and metal strap 103 extends vertically, toward the top surface of the structural wood subassembly. In various embodiments, metal strap 103 extends to the top surface of the structural wood subassembly, short of the top surface of the structural wood subassembly, or beyond the top surface of the structural wood subassembly.

Figure 3:
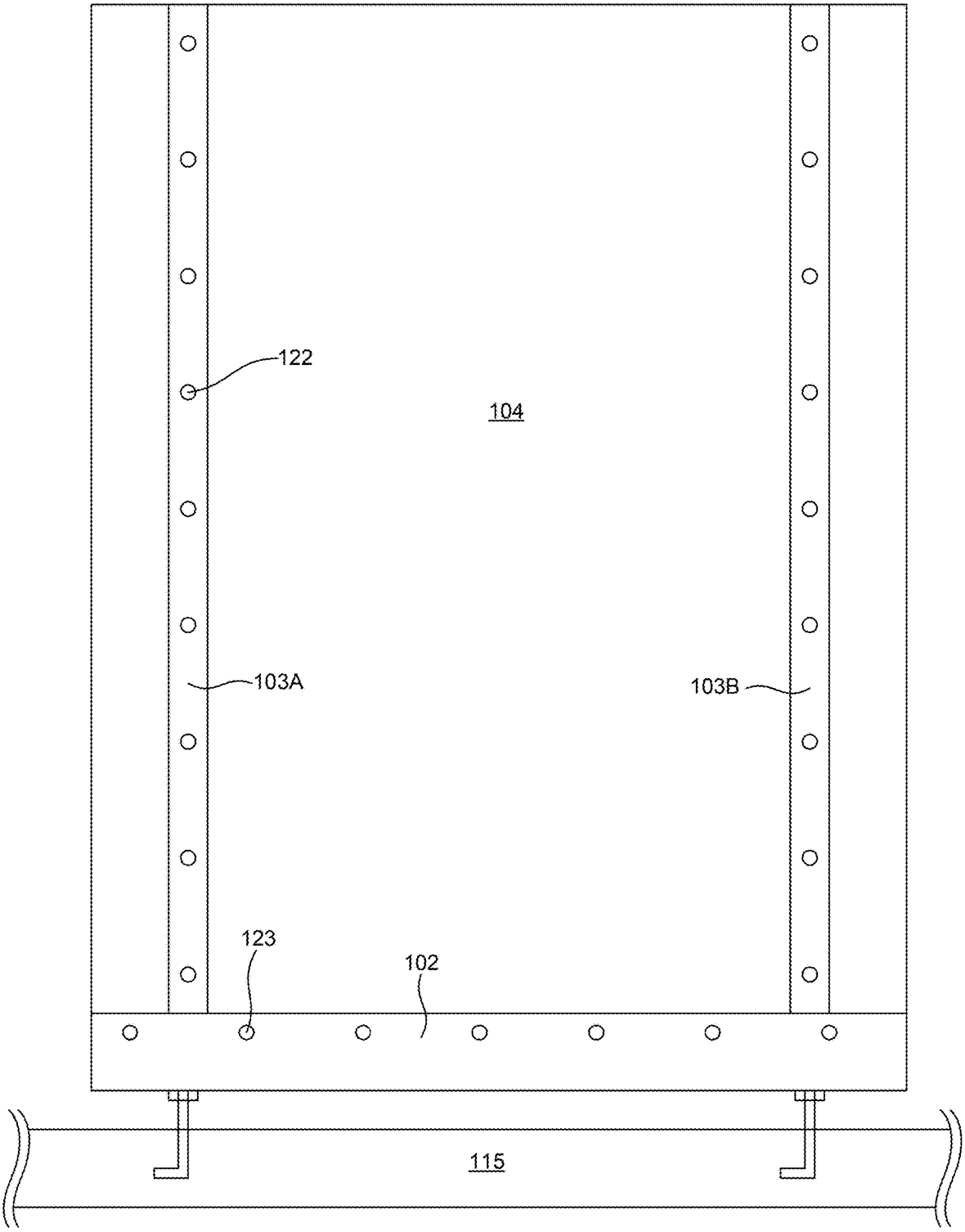
FIG. 3 is a diagram illustrative of an exterior view of a prefabricated wall panel assembly.

FIG. 3 is a diagram illustrative of an exterior view of a prefabricated wall panel assembly. FIG. 3 depicts mass timber panel 104 attached to a metal base angle subframe including structural angle 102 and metal strap 103. Fasteners are employed to fix the structural wood subassembly to the metal base angle subframe in accordance with applicable building codes. In some other embodiments, fasteners employed to fix the structural wood subassembly to the metal base angle subframe pass through the metal straps 103, the structural angle 102, or both. In some of these embodiments, all fasteners employed to fix the structural wood subassembly to the metal base angle subframe pass through the metal straps 103, the vertically oriented flange of structural angle 102, or both, however, no perforations are present through the horizontally oriented flange of structural angle 102. In this manner, the structural angle 102 provides an impermeable barrier to environmental elements, e.g., insects, water, etc., that might damage mass timber panel 104. In other embodiments, fasteners are also employed to fasten the structural wood subassembly to the metal base angle subframe through the horizontal flange of structural angle 102.

In some embodiments, mass timber panel 104 is a cross laminated timber (CLT) structure. Cross-laminated timber (CLT) is a large-scale, prefabricated, solid engineered wood panel that is lightweight, yet very strong, with superior fire, seismic and thermal performance. CLT is also fast and easy to install, generating almost no waste onsite. CLT offers design flexibility and low environmental impact. For these reasons, cross-laminated timber is proving to be a highly advantageous alternative to conventional materials like concrete, masonry or steel, especially in multifamily and commercial construction, such as education facilities.

A CLT panel includes several layers of lumber boards stacked in alternating directions, bonded with structural adhesives, and pressed to form a solid, straight, rectangular panel. CLT panels include an odd number of layers, e.g., three to seven, and may be sanded or prefinished before shipping. CLT panels are cut to size, including door and window openings, at a factory facility with state-of-the art Computer Numerical Controlled (CNC) routers. The CNC equipment is capable of cutting complex shapes with high precision. CLT panels are exceptionally stiff, strong, stable, and capable of load transfer on all sides.

In some other embodiments, mass timber panel 104 is a Nail Laminated Timber (NLT) panel, Dowel Laminated Timber (DLT) panel, mass plywood, etc., a manufactured timber product such as a Laminated Veneer Lumber (LVL) panel, Parallel Strand Lumber (PSL) panel, glue laminated timber panel, etc. In some embodiments, the mass timber panel is reinforced by light gauge structural steel fastened to the timber (e.g., using glue, mechanical fasteners, etc.).

In some embodiments, the exterior facing sheathing layer is fabricated from a manufactured timber product such as plywood, oriented strand board, etc.

In some embodiments, the structural wood subassembly includes a mass timber panel only; without a sheathing layer.

In another further aspect, a wall panel subassembly includes an interior facing finishing layer attached to the structural wood subassembly. As depicted in FIG. 1, interior facing finishing layer 113 is attached to mass timber panel 104. In one example, finishing layer 113 includes sheetrock panels that are finished and painted. In some other examples, finishing layer 113 includes tile, decorative panels, such as fiber reinforced plastic panels, etc.

In some other embodiments, the interior facing side of mass timber panel 104 is directly exposed to the building interior and not covered by any finishing layer. In this manner, the natural wooden appearance of the mass timber panel 104 is the visible interior finish.

In another aspect, one or more utility chases are fabricated into the mass timber panel 104 during fabrication. A utility chase is a cavity or channel fabricated into the mass timber panel to accommodate mechanical elements of the building, e.g., electrical, plumbing, communications infrastructure, etc. In some embodiments, some or all of the mechanical elements are also located within the utility chase prior to erection of the wall panel subassembly. FIG. 1 depicts a utility chase 114 fabricated within mass timber panel 104, including an interior facing opening 130. In one example, interior facing opening 130 is sized to accommodate electrical infrastructure, e.g., an electrical box to accommodate user interface devices such as light controls, HVAC controls, etc.

In another further aspect, a wall panel subassembly includes a weather resistive membrane attached to the structural wood subassembly. As depicted in FIG. 1, a weather resistive membrane 106 is attached to the exterior sheathing layer 105. Weather resistive membrane 106 provides a material layer to block environmental elements, e.g., insects, water, etc., that might damage mass timber panel 104.

In another further aspect, wall panel subassembly 101 includes an insulation layer attached to the exterior face of the structural wood subassembly, e.g., sheathing layer 105. As depicted in FIG. 1, insulation layer 107 is disposed between external finishing layer 108 and weather resistive layer 106.

In another further aspect, wall panel subassembly 101 includes one or more metal flashing elements attached to the exterior face of the structural wood subassembly, e.g., sheathing layer 105. In some embodiments, a flashing 117 is attached to sheathing layer 105. Flashing 117 works with weather resistive membrane 106 to direct any water that penetrates exterior finishing layer 108 away from the structural wood subassembly. In some embodiments, flashing elements are attached to sheathing layer 105 along the perimeter of the prefabricated wall panel, around openings of any windows or doors integrated with the prefabricated wall panel, etc.

In another further aspect, wall panel subassembly 101 includes an exterior finishing layer 108 attached to the exterior facing side of the wall panel subassembly. In general, any suitable external finish may be applied, e.g., stucco, weatherproof panels, siding, etc.

As depicted in FIG. 1, all of the elements of wall panel subassembly 101 are assembled prior to erection of the wall panel subassembly 101 as part of a prefabricated building system.

FIG. 1 depicts several elements of a prefabricated wall panel assembly 101 in one embodiment. However, in general, some elements of the prefabricated wall panel subassembly 101 are optional. For example, any of interior finish layer 113, utility chase 114, external sheathing 105, weather resistive layer 106, insulation layer 107, and external finish layer 108 are optional, or may be installed after erection of the prefabricated building structure.

In another further aspect, a number of prefabricated wall panel assemblies are erected as part of a prefabricated building system. In addition, each prefabricated wall panel assembly is mounted to a concrete foundation with a desired offset distance between the bottom of each prefabricated wall panel assembly and the foundation. By separating the prefabricated wall panel assembly from the foundation by a distance, exposure of the prefabricated wall panel assembly to destructive environmental elements, e.g., water, insects, termites, etc., is minimized.

FIG. 1 depicts an anchor bolt assembly including anchor bolt 109 embedded in foundation 115, leveling nut 110, and locking nut 111. Each anchor bolt assembly fixes the horizontally oriented flange of structural angle 102 to the foundation 115 at a desired offset distance, D. Anchor bolt 109 extends from foundation 115 through the horizontally oriented flange of structural angle 102. Leveling nut 110 is turned onto anchor bolt 109 and the bottom of the horizontally oriented flange of structural angle 102 rests on leveling nut 109. The position of leveling nut 110 on anchor bolt 109 sets the desired offset distance of the prefabricated wall panel subassembly 101 from foundation 115. Locking nut 111 is also turned onto anchor bolt 109 until locking nut 111 is in contact with the top of the horizontally oriented flange of structural angle 102. Locking nut 111 is tightened to a desired torque to effectively clamp the horizontally oriented flange of structural angle 102 between leveling nut 110 and locking nut 111.

In addition, grout 112 is applied between the foundation and the horizontally oriented flange of structural angle 102 to close the void created by the desired offset distance. In some embodiments, the desired offset between the foundation and the bottom of the prefabricated wall panel subassembly 101 is approximately one and one-half inches. However, in general, any suitable offset distance may be employed.

Figure 4:
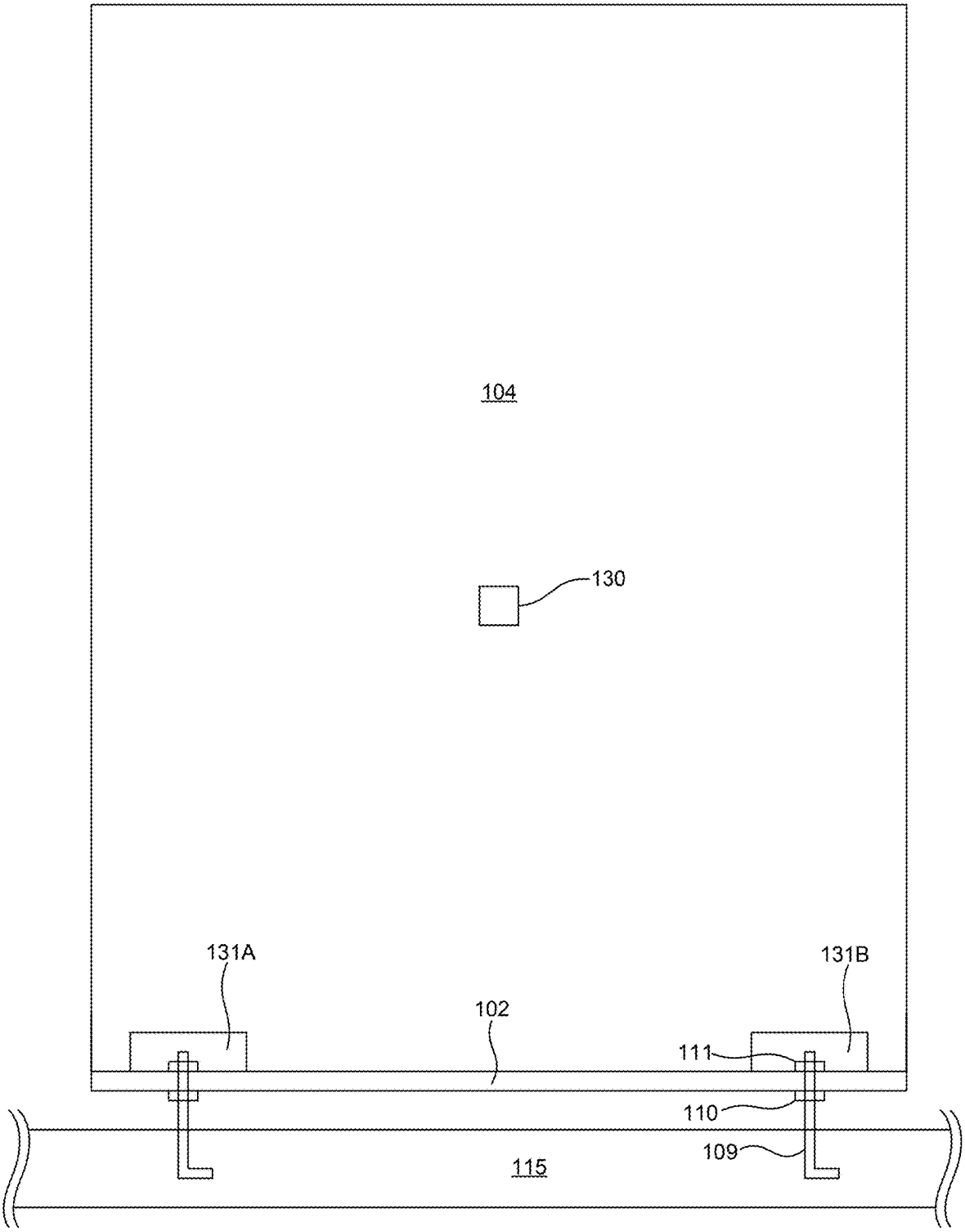
FIG. 4 is a diagram illustrative of an interior view of a prefabricated wall panel assembly.

FIG. 4 is a diagram illustrative of an interior view of a prefabricated wall panel assembly. As depicted in FIG. 4, openings 131A and 131B are fabricated into mass timber panel 104 to allow space to access locking nut 111 of two anchor bolt assemblies. As depicted in FIG. 1, a finishing layer 116, e.g., a wall cove base, baseboard molding, etc., is applied to the prefabricated wall panel assembly to cover opening 131 after erection of the prefabricated wall panel.

In some embodiments, two anchor bolt assemblies are employed to fix each prefabricated wall panel subassembly to a building foundation. However, in general, any suitable number of anchor bolt assemblies may be employed to fix each prefabricated wall panel subassembly to a building foundation.

In some embodiments, each prefabricated wall panel subassembly is attached to a raised building foundation, e.g., curb. However, in some embodiments, such as the embodiment depicted in FIG. 1, each prefabricated wall panel subassembly is attached to a flat foundation, i.e., a foundation having the same height at both the floor of the building and the location of attachment of each of the prefabricated wall panel subassemblies. In conventional construction, a raised foundation curb is typically employed to provide a weather barrier between wall panel subassemblies and the external environment. However, the combination of the metal base angle subframe and the positioning of each prefabricated wall panel subassembly over the foundation at an offset distance as described herein provides sufficient protection from the environment. Thus, the novel wall panel assemblies described herein enable reliable building construction without the extra expense of forming and pouring a raised foundation curb.

In another aspect, a prefabricated building assembly includes a number of prefabricated wall panel assemblies integrated into a perimeter wall, a set of support beams attached across the perimeter walls, and a set of prefabricated roof panels disposed on the set of support beams.

Figure 5:
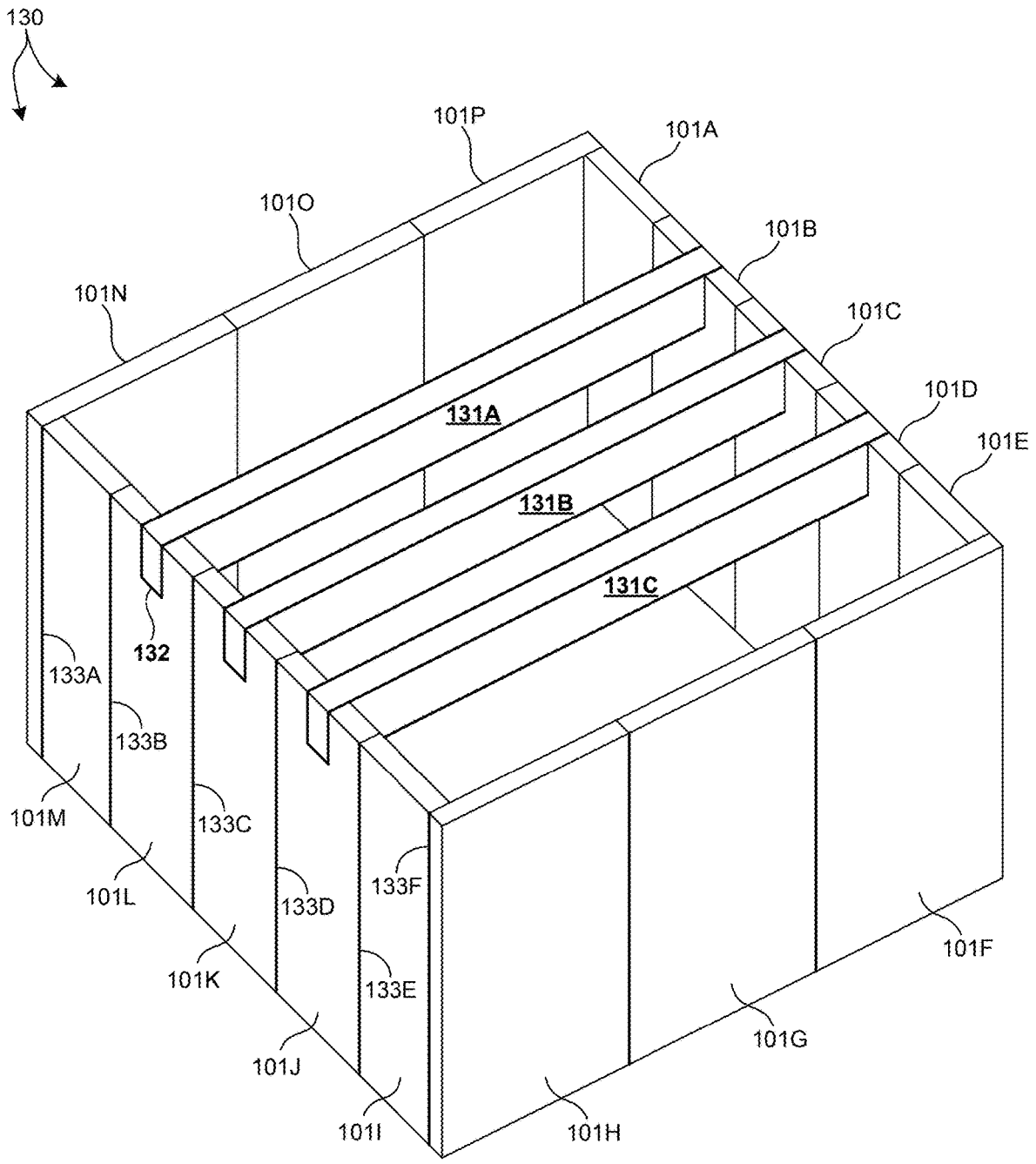
FIG. 5 is a diagram illustrative of a prefabricated building system including prefabricated wall panel assemblies and load bearing beams.

FIG. 5 is a diagram illustrative of prefabricated building assembly 130 including prefabricated wall panel assemblies 101A-P erected to form a four-sided perimeter wall. In some embodiments, adjacent prefabricated wall panel assemblies are positioned with a gap of approximately one-half inch between adjacent wall panel assemblies. Backer rod is employed to fill each gap, and caulk is applied over the backer rod between flashings. In some embodiments, adjacent prefabricated wall panel assemblies are positioned with a relatively large gap to accommodate a glass panel frame, a door frame, etc. Such gaps may be present on any wall, however, a prefabricated wall panel assembly is always located below a load bearing beam to provide structural support. FIG. 5 depicts caulking joints 133A-F sealing the space between prefabricated wall panel assemblies 101N and 101M, 101M and 101L, 101L and 101K, 101K and 101J, 101J and 101I, and 101I and 101H, respectively.

Load bearing beams are positioned atop prefabricated wall panel assemblies positioned along two opposing sections of the continuous perimeter wall. In this manner, the load bearing beams span across the interior space of the building. Each load bearing beam structure has a direction of longitudinal extent spanning the interior space of the building and a cross-sectional shape extending in a vertical direction and a horizontal direction. The vertical direction and the horizontal direction are perpendicular to the direction of longitudinal extent. Each load bearing beam structure supports a load having a component aligned substantially with the vertical direction.

In some embodiments, each load bearing beam structure is inserted in a corresponding void, i.e., notch, formed at the top of a matching prefabricated wall panel subassembly. The notch is sized to fit the cross-section of the load bearing beam structure, such that the top of a load bearing support beam is at the same height as the top of the prefabricated wall panel subassembly when installed. The notch is a void through the thickness of the prefabricated wall panel subassembly that extends a distance from the top surface of a prefabricated wall panel subassembly toward the bottom surface of the prefabricated wall panel subassembly. The distance matches the vertical height of the cross-section of the load bearing beam structure.

FIG. 5 depicts load bearing beam structures 131A-C spanning the space between prefabricated wall panel subassemblies 101L and 101B, 101K and 101C, and 101J and 101D, respectively. In addition, FIG. 5 depicts notch 132 formed into the top of prefabricated wall panel subassembly 101L. As depicted in FIG. 5, load bearing beam structure 131A fits into notch 132 such that the top of load bearing beam 131A is the same height as the top of prefabricated wall panel subassembly 101L.

In general, a load bearing beam structure is a mass timber beam, a manufactured timber product such as a LVL beam, a PSL beam, a glue laminated timber beam, etc. In some embodiments, the load bearing beam structure is reinforced by structural steel fastened to the timber (e.g., using glue, mechanical fasteners, etc.).

In some embodiments, load bearing beam structures are left fully exposed to view from the space below. In some other examples, load bearing beam structures are concealed with a separate ceiling subassembly. If left fully exposed, ductwork and other utilities are also left exposed, leaving a more industrial, exposed structural appearance. If a ceiling subassembly is installed, the beams, ductwork, and other utilities are concealed from view by the separate ceiling assembly. In some examples, a ceiling subassembly includes a structural falsework to support acoustic tile, gypsum board, or other finish ceiling materials placed to create a level ceiling system.

In some embodiments, window or door panel assemblies are integrated into a prefabricated wall panel subassembly.

Figure 6:
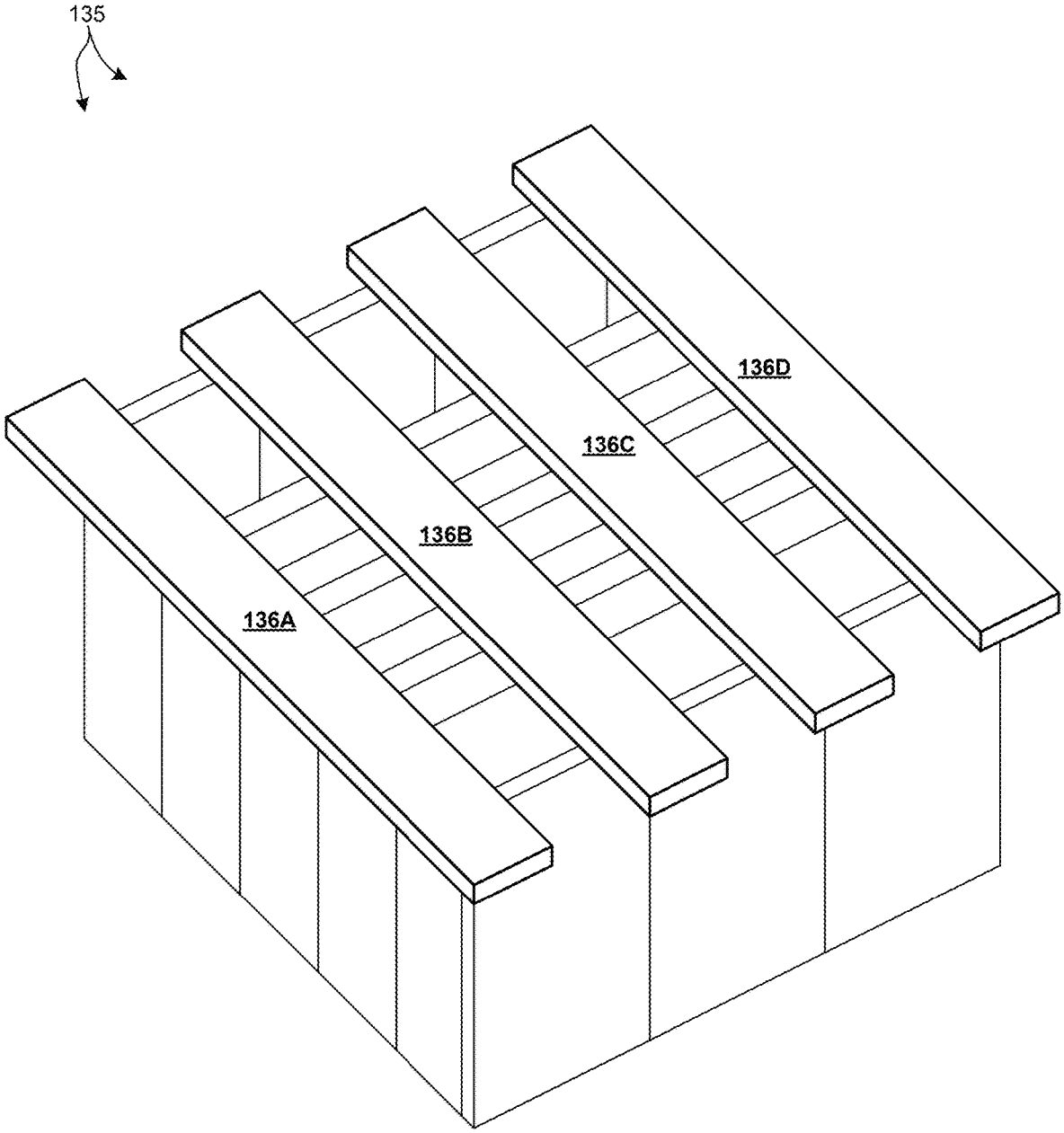
FIG. 6 is a diagram illustrative of a prefabricated building system including prefabricated wall panel assemblies, load bearing beams, and cross-laminated timber (CLT) beams of a prefabricated roof panel subassembly.

FIG. 6 depicts an embodiment of a prefabricated building system 135 including CLT panels 136A-D disposed above and attached to the load bearing beam structures. The CLT panels have a direction of longitudinal extent and a rectangular cross-sectional profile perpendicular to the direction of longitudinal extent. The direction of extent of each CLT panel 136A-D is transverse to the direction of extent of each of the load bearing beam structures 131A-C.

Figure 7:
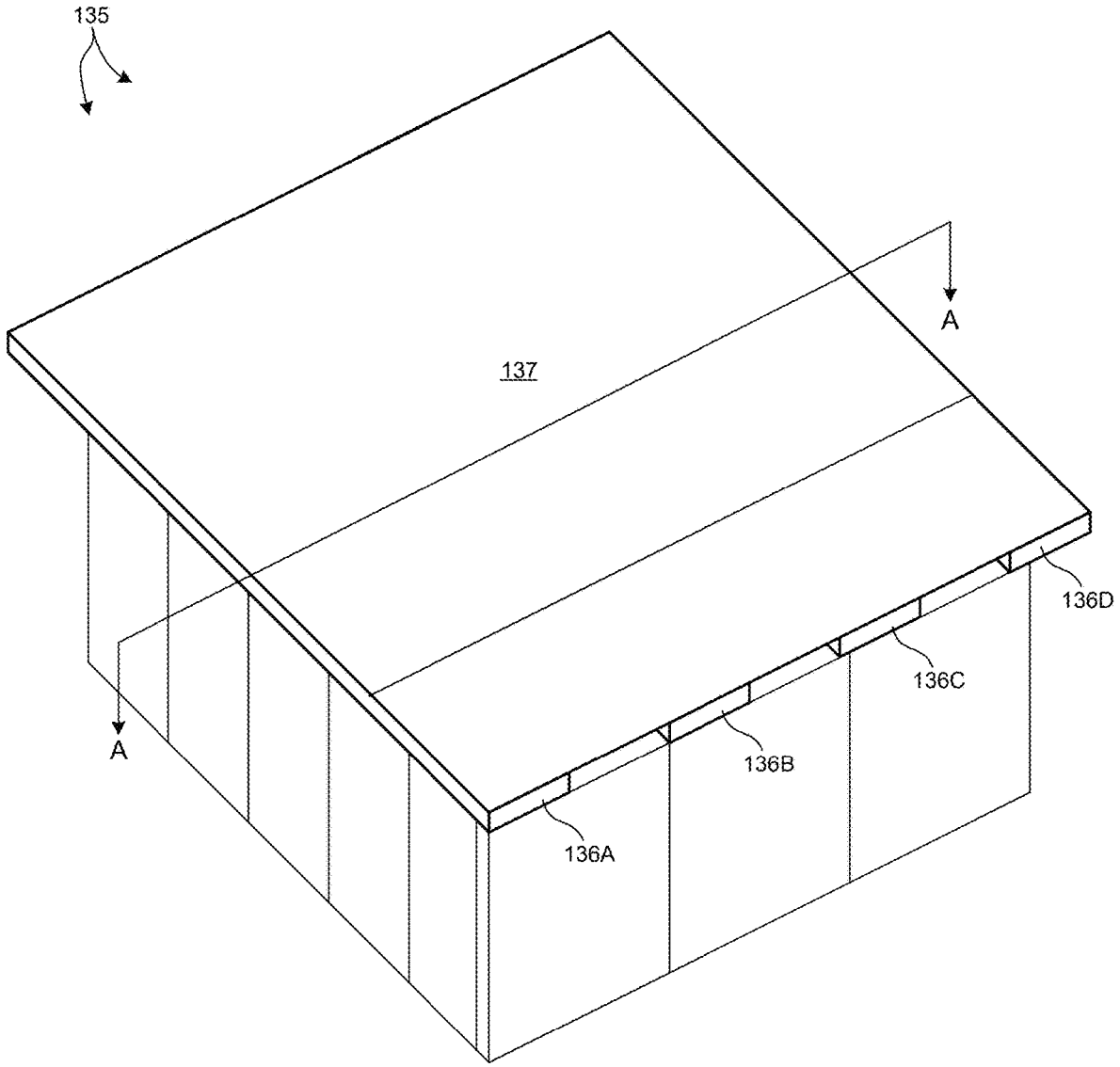
FIG. 7 is a diagram illustrative of a prefabricated building system including a prefabricated wall panel assembly, load bearing beams, and a prefabricated roof panel subassembly.

FIG. 7 depicts the embodiment of the prefabricated building system 135 including sheathing panels 137 coupled to the top surface of the CLT panels 136A-D. Each CLT panel includes sheathing panels extending past the CLT panels in a direction perpendicular to the direction of extent of the CLT panel. Together each CLT panel and any sheathing panels fastened to the CLT panel comprises a prefabricated roof panel subassembly. In this manner, prefabricated roof sections including a CLT beam and attached sheathing are erected together to form the roof structure of a prefabricated building system 135.

Exemplary sheathing panels include, but are not limited to plywood, oriented strand board, fiber cement board, composite sheet, plastic laminate, or other suitable material.

Figure 8:
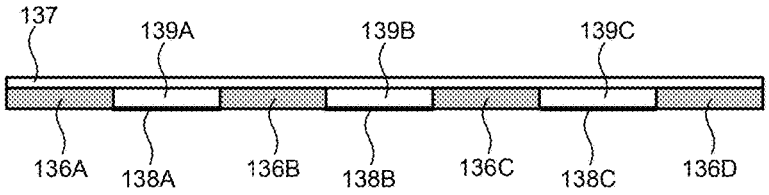
FIG. 8 is a diagram illustrative of a cross-sectional view of a prefabricated roof panel subassembly.

FIG. 8 is a view of cross-section A-A depicted in FIG. 7. As depicted in FIG. 8, the roof assembly leaves voids 139A-C between CLT beams 136A-D, respectively. These voids may be utilized to house building utilities, e.g., electrical, plumbing, etc. In some embodiments, a falsetto ceiling element is coupled to each of the plurality of prefabricated roof panel subassemblies to cover the void between adjacent CLT panels. FIG. 8 depicts falsetto ceiling panels 138A-C covering voids 139A-C, respectively.

Figure 9:
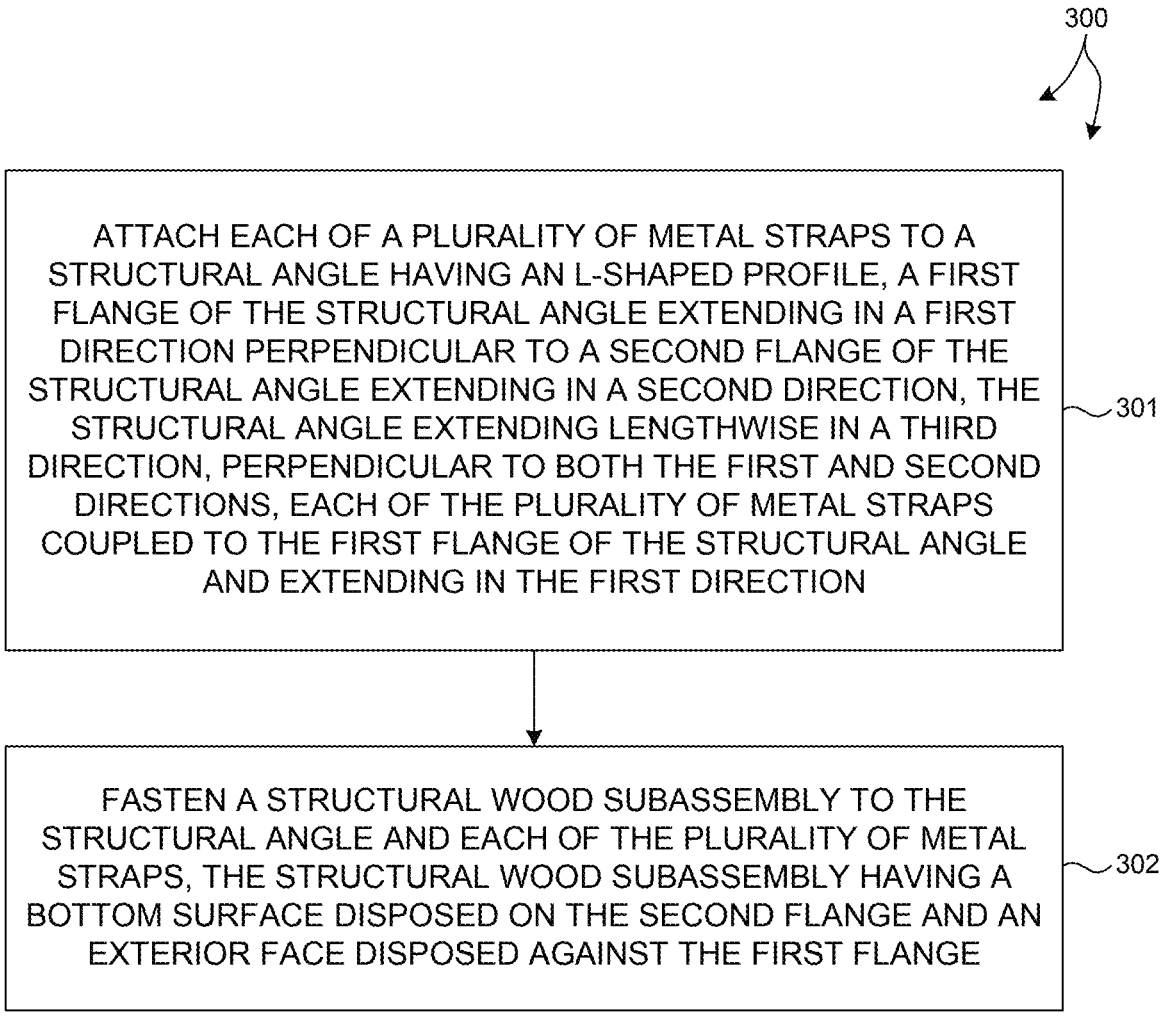
FIG. 9 illustrates a method 300 suitable for assembling a prefabricated wall panel subassembly in accordance with at least one inventive aspect.

FIG. 9 illustrates a method 300 suitable for producing a prefabricated wall panel subassembly in accordance with at least one inventive aspect.

In block 301, each of a plurality of metal straps are attached to a structural angle having an L-shaped profile. A first flange of the structural angle extends in a first direction perpendicular to a second flange of the structural angle which extends in a second direction. The structural angle extends lengthwise in a third direction, perpendicular to both the first and second directions. Each of the plurality of metal straps is coupled to the first flange of the structural angle and extends in the first direction.

In block 302, a structural wood subassembly is fastened to the structural angle and each of the plurality of metal straps. The structural wood subassembly has a bottom surface disposed on the second flange and an exterior face disposed against the first flange.

Although certain specific embodiments are described above for instructional purposes, the teachings of this patent document have general applicability and are not limited to the specific embodiments described above. Accordingly, various modifications, adaptations, and combinations of various features of the described embodiments can be practiced without departing from the scope of the invention as set forth in the claims.

What is claimed is:

1. A prefabricated building assembly, comprising:

a plurality of prefabricated wall panel subassemblies, each of the plurality of prefabricated wall panel subassemblies having an interior face, an exterior face, a top surface, a bottom surface, and two side surfaces opposite one another, each of the plurality of prefabricated wall panel subassemblies comprising, a metal base angle subframe, the metal base angle subframe comprising:

a structural angle having an L-shaped profile, a first flange of the structural angle extending in a first direction perpendicular to a second flange of the structural angle extending in a second direction, the structural angle extending lengthwise in a third direction, perpendicular to both the first and second directions, along the bottom surface of a prefabricated wall panel subassembly;

a plurality of metal straps, each extending in the first direction toward the top surface of the prefabricated wall panel subassembly; and a structural wood subassembly having a bottom surface disposed on the second flange and an exterior face disposed against the first flange, the structural wood subassembly fastened to each of the plurality of metal straps of the metal base angle subframe;

a plurality of load bearing beam structures each having a direction of longitudinal extent and a cross-sectional shape extending in a vertical direction and a horizontal direction, both the vertical direction and the horizontal direction perpendicular to the direction of longitudinal extent, each load bearing beam structure configured to support a load having a component aligned substantially with the vertical direction, each of the plurality of load bearing beam structures inserted in a corresponding void of each of a subset of the plurality of prefabricated wall panel subassemblies; and a plurality of prefabricated roof panel subassemblies disposed above and attached to the load bearing beam structures.

2. The prefabricated building assembly of claim 1, wherein the subset of the plurality of prefabricated wall panel subassemblies include at least one void through a thickness of the prefabricated wall panel subassembly, the void extending from a portion of the top surface toward the bottom surface.

3. The prefabricated building assembly of claim 1, each of the plurality of prefabricated wall panel subassemblies further comprising:

a first metal end cap fixed across the L-shaped profile at a first end of the structural angle; and a second metal end cap fixed across the L-shaped profile at a second end of the structural angle.

4. The prefabricated building assembly of claim 3, wherein at least one of the plurality of metal straps is coupled to the first metal end cap and at least another one of the plurality of metal straps is coupled to the second metal end cap.

5. The prefabricated building assembly of claim 1, wherein at least one of the plurality of metal straps is coupled to the structural angle.

6. The prefabricated building assembly of claim 1, further comprising:

a plurality of anchor bolt assemblies, each of the plurality of anchor bolt assemblies fixing the second flange of the metal base angle subframe of a prefabricated wall panel subassembly of the plurality of prefabricated wall panel subassemblies to a foundation at a desired offset distance, each of the plurality of anchor bolt assemblies comprising:

an anchor bolt extending from the foundation through the second flange of a corresponding prefabricated wall panel subassembly;

a leveling nut attached to the anchor bolt, wherein a bottom of the second flange of the prefabricated wall panel assembly rests on the leveling nut at the desired offset distance from the foundation; and a locking nut attached to the anchor bolt and in contact with a top of the second flange, wherein the locking nut clamps the second flange of the prefabricated wall panel subassembly between the leveling nut and the locking nut.

7. The prefabricated building assembly of claim 6, where two anchor bolt assemblies fix the second flange of the metal base angle subframe of a prefabricated wall panel subassembly to the foundation at a desired offset distance.

8. The prefabricated building assembly of claim 6, further comprising:

an amount of grout applied between the foundation and the bottom of the second flange of the prefabricated wall panel assembly to close a void created by the desired offset distance.

9. The prefabricated building assembly of claim 6, wherein a height of a top surface of the foundation is the same height as a floor surface of the prefabricated building assembly.

10. The prefabricated building assembly of claim 6, further comprising:

an amount of caulking applied between a side surface of a first of the plurality of prefabricated wall panel subassemblies and a side surface of a second of the plurality of prefabricated wall panel subassemblies, wherein the first and second prefabricated wall panel subassemblies are disposed adjacent to one another along the foundation.

11. The prefabricated building assembly of claim 1, each of the plurality of prefabricated roof panel subassemblies comprising:

a Cross-Laminated Timber (CLT) panel having a direction of longitudinal extent and a rectangular cross-sectional profile perpendicular to the direction of longitudinal extent, the direction of longitudinal extent of the CLT panel of each prefabricated roof panel subassembly is transverse to the direction of longitudinal extent of each of the load bearing beam structures.

12. The prefabricated building assembly of claim 11, each of the plurality of prefabricated roof panel subassemblies further comprising:

a plurality of plywood panels coupled to a top surface of the CLT panels, each of the plurality of plywood panels extending past the CLT panels in a direction perpendicular to the direction of longitudinal extent of the CLT panel.

13. The prefabricated building assembly of claim 11, further comprising:

a falsetto ceiling element coupled to each of the plurality of prefabricated roof panel subassemblies to cover a void between adjacent CLT panels.

14. The prefabricated building assembly of claim 1, wherein each load bearing beam structure is a Cross-Laminated Timber structure.

15. A prefabricated wall panel, comprising:

a structural wood subassembly having an interior facing surface, an exterior facing surface, a top surface, and a bottom surface; and a metal base angle subframe, the metal base angle subframe comprising:

a structural angle having an L-shaped profile, a first flange of the structural angle extending in a first direction perpendicular to a second flange of the structural angle extending in a second direction, the structural angle extending lengthwise in a third direction, perpendicular to both the first and second directions, along the bottom surface of the structural wood subassembly, the bottom surface of the structural wood subassembly disposed on top of the second flange, the exterior facing surface of the structural wood subassembly disposed adjacent to the first flange; and a plurality of metal straps, each metal strap extending along the exterior facing surface of the structural wood subassembly in the first direction toward the top surface of the structural wood subassembly, the structural wood subassembly fastened to each of the plurality of metal straps of the metal base angle subframe.

16. The prefabricated wall panel of claim 15, wherein the structural wood subassembly includes a mass timber panel.

17. The prefabricated wall panel of claim 16, the structural wood subassembly, further comprising:

an exterior sheathing layer attached to the mass timber panel, the exterior sheathing layer disposed between the mass timber panel and the plurality of metal straps.

18. The prefabricated wall panel of claim 15, further comprising:

a weather resistive membrane disposed over at least a portion of the structural wood subassembly.

19. The prefabricated wall panel of claim 15, further comprising:

an insulation layer disposed over at least a portion of the structural wood subassembly.

20. The prefabricated wall panel of claim 15, further comprising:

an exterior finishing layer disposed over at least a portion of the structural wood subassembly.

21. The prefabricated wall panel of claim 15, further comprising:

a metal flashing element attached to the exterior finishing layer along a perimeter of the prefabricated wall panel.

22. The prefabricated wall panel of claim 15, further comprising:

a utility chase fabricated in the structural wood subassembly.

23. The prefabricated wall panel of claim 15, further comprising:

an interior finishing layer attached to an interior facing side of the structural wood subassembly.

24. The prefabricated wall panel of claim 15, wherein the structural wood subassembly includes at least one void through a thickness of the structural wood subassembly, the void extending from a portion of the top surface toward the bottom surface.

25. The prefabricated wall panel of claim 15, further comprising:

a first metal end cap fixed across the L-shaped profile at a first end of the structural angle; and a second metal end cap fixed across the L-shaped profile at a second end of the structural angle.

26. The prefabricated wall panel of claim 25, wherein at least one of the plurality of metal straps is coupled to the first metal end cap and at least another one of the plurality of metal straps is coupled to the second metal end cap.

27. The prefabricated wall panel of claim 15, wherein at least one of the plurality of metal straps is coupled to the structural angle.

* * * * *